US005205449A

United States Patent [19]

Davies

[11] Patent Number: 5,205,449

[45] Date of Patent: Apr. 27, 1993

[54] FOREARM GAUGE AND EQUIPMENT HOLDER FOR SCUBA DIVERS

[76] Inventor: Stephen T. Davies, 2351 Jackson St. #9, San Francisco, Calif. 94115

[21] Appl. No.: 954,158

[22] Filed: Sep. 30, 1992

[51] Int. Cl.[5] ..... A44C 5/00

[52] U.S. Cl. ..... 224/152; 224/165; 224/219; 368/281

[58] Field of Search ..... 224/164, 165, 168–171, 224/180, 191, 219, 221, 222, 232, 242, 249, 267, 271, 152, 233; 405/185, 186; 2/16, 22; 368/280, 281, 282, 286; 73/300, 431

[56] References Cited

U.S. PATENT DOCUMENTS

| | | | |
|---|---|---|---|
| 4,197,747 | 4/1980 | Koehler | 368/286 |
| 4,211,289 | 7/1980 | Klein | 172/686 |
| 4,404,747 | 9/1983 | Collins | 224/232 |
| 4,466,283 | 8/1984 | Osterhout | 73/300 |
| 4,466,285 | 8/1984 | Allemano | 368/281 |
| 4,509,667 | 4/1985 | Meldrum | 224/250 |
| 4,586,136 | 4/1986 | Lewis | 364/418 |
| 4,913,326 | 4/1990 | Echelson | 224/222 |
| 4,974,762 | 12/1990 | Boretsky et al. | 224/148 |

OTHER PUBLICATIONS

"Skin Diver Magazine", Sep. 1989, pp. 48–49, by J. Walker.

U.C.B. Division of Diving Control, Lloyd F. Austin, 1959, "Gauntlet w Gauges & Watch".

*Primary Examiner*—Henry J. Recla

*Assistant Examiner*—Robert A. Goldman

[57] ABSTRACT

An improved mounting assembly for mounting gauges and devices to a divers forearm. The assembly is comprised of a flexible material with provisions for rigid components to be placed therein. Rigid components provide structural integrity and secure gauges and devices. Gauges and devices may be easily removed, inserted, or exchanged while the unit is not being worn. When worn, the device may not be manipulated in such a manner as to allow gauges and devices to be easily moved. A compass holder (38) and a depth gauge holder (36) are sized to fit a variety of gauges commonly available. A rigid ring (62) with an inside diameter sized to fit specific models of gauges prevents gauges from rotating and popping out of device. Large overhangs comprised of flexible material hold devices conforming to the shape of a typical watch and diver's thermometer. A writing tablet and pencil may be secured to the inside arm of the device and are held in place by means of overhangs (40), friction, and compression. Provision is made for a secondary means to secure a pencil (44). A knife sheath may be inserted into divers outside arm side. Knife sheath is secured to device by means of plastic tabs (70) inserted through the sheath and which interface with recepticles (32) in the device. Air channels (58), encased rigid rods (24), a contored interior surface (52), and hook and loop fasteners (20) prevent the device from slipping and rolling on the arm.

7 Claims, 4 Drawing Sheets

6-1

FOREARM GAUGE AND EQUIPMENT HOLDER FOR SCUBA DIVERS

BACKGROUND

1. Field of Invention

This invention relates to scuba diving, specifically, scientific research diving, diving safety training, sport and professional diving.

2. Background of the Invention

Divers commonly determine safe diving parameters through the use of an ambient pressure sensitive depth gauge and a chronometer. These instruments are worn or attached to the person by means of separate, independent, mounting devices. Alternatively, either one or both are secured to a divers tank pressure gauge. Readings from these instruments are then cross-referenced to dive tables.

The use of separate, independent, mounting devices to attach instruments to a divers person is problematic. It takes more time to attach separate mounting devices. Divers must search their gear bags for at least two components. Since the operative use of the instruments in dive planning is co-dependent upon each other, if one mounting device is lost, the remaining unit will not be sufficient to ensure diver safety.

In practice, divers frequently carry more than two devices to their person by means of separate, independent mounting assemblies. It is necessary to maintain a record of dive data if one is engaging in multiple diving activities. To this end, divers often employ the use of a slate or writing tablet affixed to their person or held in a pocket. Other devices included in regular use are a compass, knife, and thermometer. It is difficult and cumbersome to securely mount multiple devices on a single convienient location on the divers body using independent mounting devices.

Attaching divers gauges and equipment to a tank pressure gauge housing is also problematic. The pressure gauge is directly connected to the divers air supply and the housing is allowed to drift freely at the end of a connecting hose. During an emergency or exercise, the tank is often removed. Any device attached to the tank will not always be accessible.

Bottom timers combine functions and may be worn on the wrist. However, since they only have one display surface, they are more difficult to read than single function devices. With built in safety margins, dive computers are not as accurate as single function devices. In addition, these devices are considerably more expensive and more difficult to replace than single function components. Since the dive tables or algorythms within dive computers are based upon operating assumptions, they are not versitile under a variety of operating conditions. Thus, even with multi-function devices, there is still a need for mounting single-function devices in an efficeint manner.

Preferred devices are those that can present relevant data clearly, can accommodate variable operating conditions, and are not cumbersome in use. Single function analog gauges are prefered over multiple function digital devices in cases where gauge data is required quickly and where proven instruments are essential. There is a strong need for a means of enabling the prefered gauges to be effectively utilized. None of the existing systems for mounting gauges enables the preferred gauges to be effectively utilized.

SUMMARY OF THE INVENTION

The purpose of the invention is to facilitate diver safety training and enhance sport, research, and professional diving. It is an object of this invention to provide means for securing large, easily read, single function dive instruments to a divers person. It is further the object of this invention to provide a single assembly to hold dive instruments and devices essential to safe diving operations. It is an additional object of this invention to provide efficient means by which secured instruments can be added or removed from the assembly while in the field. It is a further object of the invention that the invention may be used with or without the use of an air tank and that it will not interfere with the removal or donning of an air tank. It is another object of the invention to provide secured gauges and devices in a position of the diver's person that enables the gauges to be visible while operating equipment. It is another object of the invention that it may be adjusted to fit over different types of materials, not interfere with the operation of an environmental suit, and to be able to be securely attached to a variety of different arm sizes. It is another object of the invention to provide means for effectively utilizing components essential to safe diving at a low cost to the consumer. Further objects and advantages of my invention will become apparent from a consideration of the drawings and ensuing description.

DRAWING FIGURES

DESCRIPTION OF THE INVENTION

Figure 1:
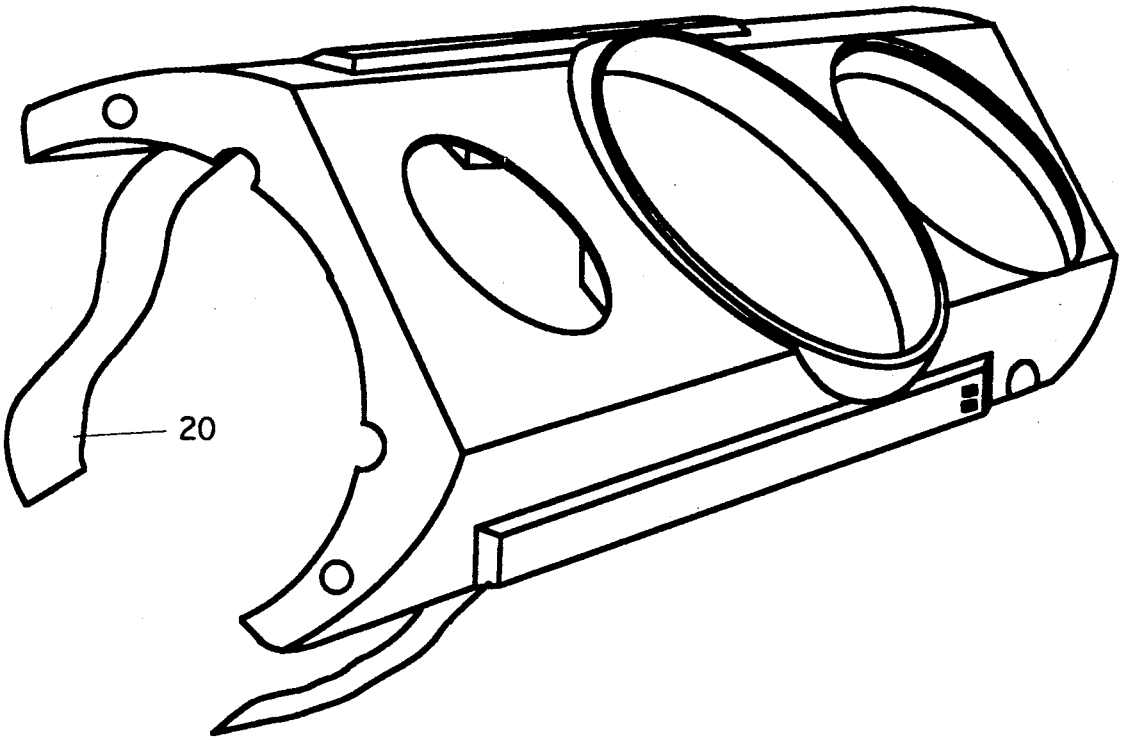
FIG. 1 is a perspective view of a device constructed in accordance with my invention showing preferred embodiment with straps.

FIG. 1 is a perspective view of a device constructed in accordance with the invention. Device (FIGS. 1–11)

is an injection molded construction of a flexible elastomer, silicone, rubber, or similar material with a shore A between 40 and 75 and a specific density less than 0.98. Straps (20) are hook and loop fasteners. Straps (20) occur at each mounting pocket (22) (FIGS. 2,5,6,10).

Figure 2:
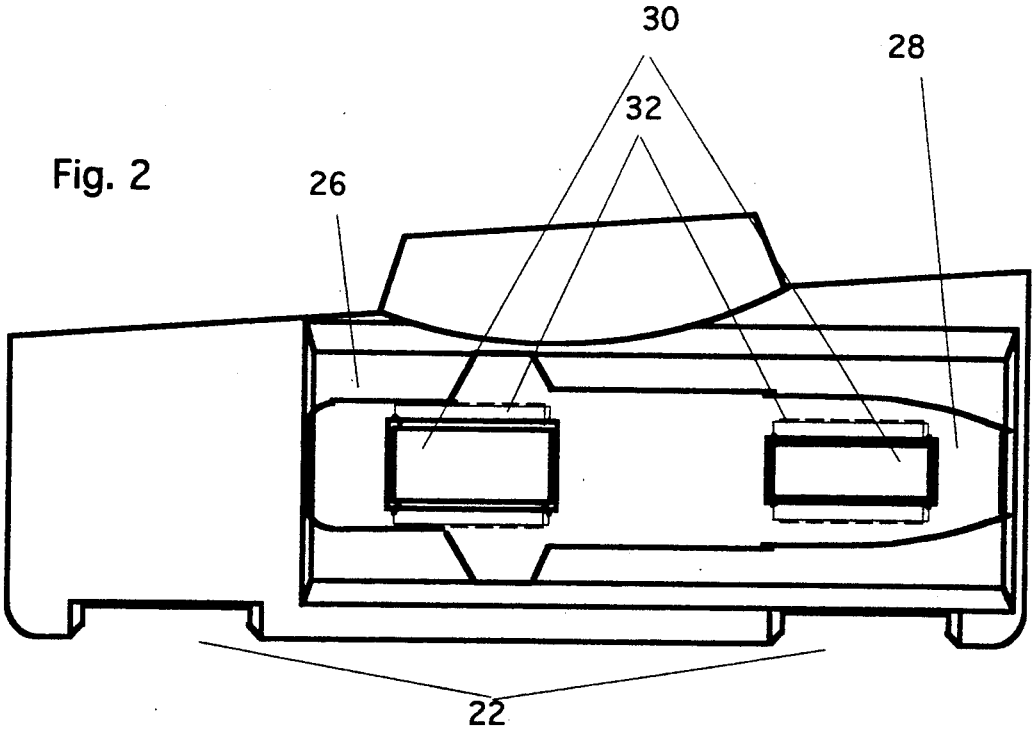
FIG. 2 is a left side view of a device constructed in accordance with my invention showing a knife plane, knife sheath holder, and mounting pockets.

FIG. 2 is a left side view showing mounting pockets (22) (FIGS. 2,5,6,10). A semi-rigid rod (24) (FIGS. 5,10,11) passes through the length of each bottom side. A knife dog, or holder, (28) (FIGS. 2,7) is an irregular shaped pocket with two deeper knife pockets (30) which contain two knife overhangs (32) each. Knife holder (28) occurs within knife plane (26).

Figure 3:
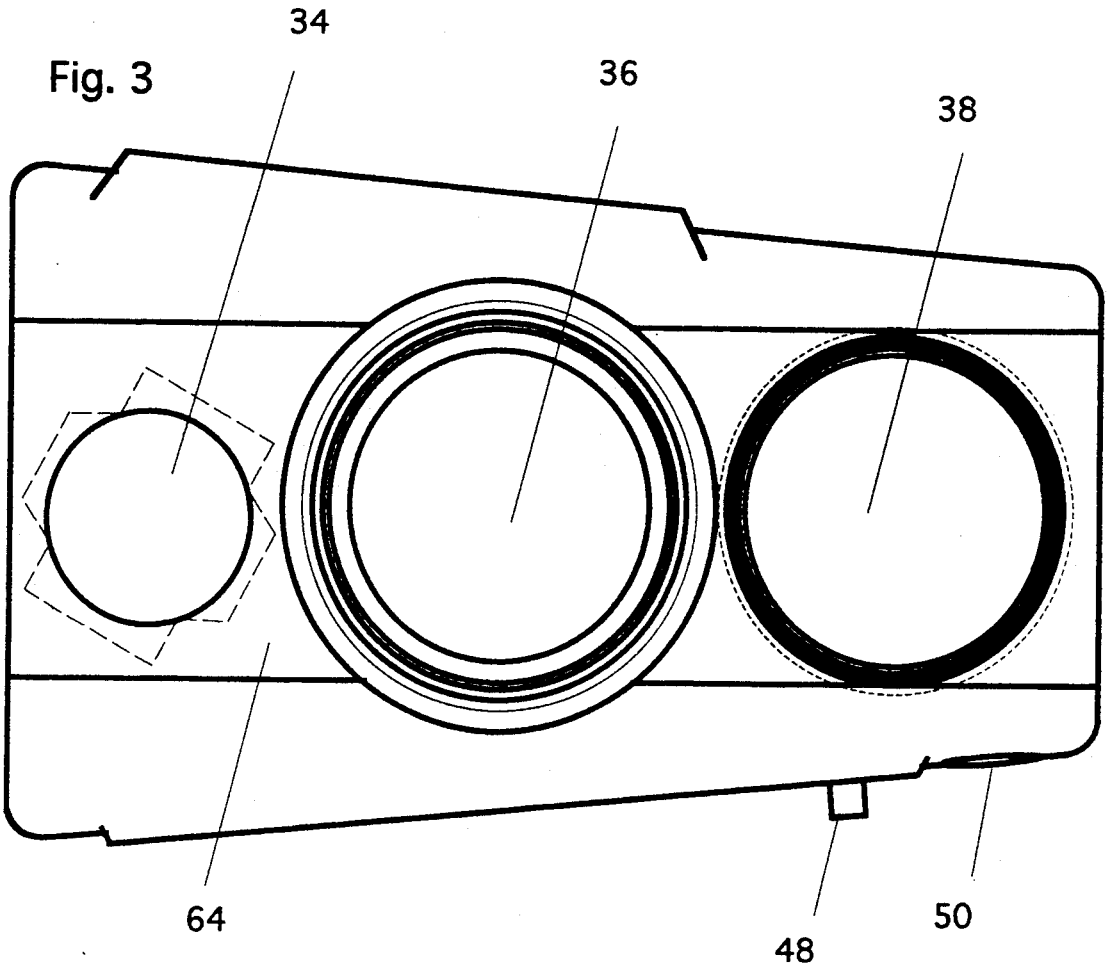
FIG. 3 is a top view of a device constructed in accordance with my invention showing gauge plane, watch, depth gauge, compass, and thermometer holders.
Figure 7:
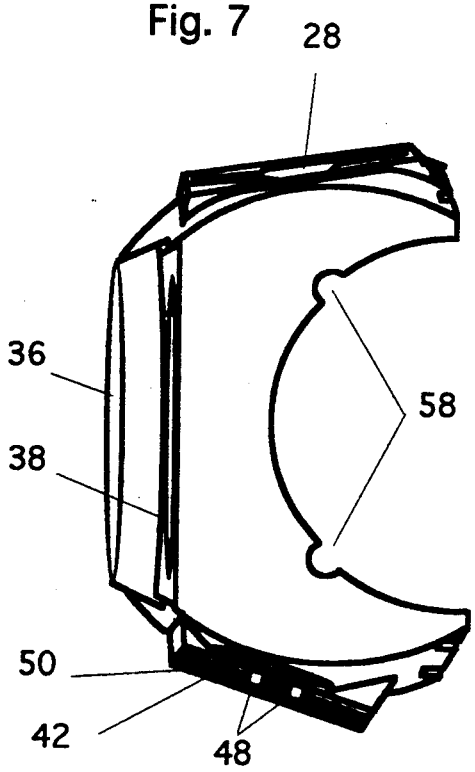
FIG. 7 is a front view of device constructed in accordance with my invention showing depth gauge pocket, compass pocket, air channels, slate holder, pencil holder, thermometer holder, and knife sheath holder.

FIG. 3 is a top view showing watch pocket (34), depth gauge pocket (36) (FIGS. 3,7), and compass pocket (38) (FIGS. 3,7). Watch (34), depth gauge (36), and compass (38) pockets occur within gauge plane (64). Depth gauge pocket (36) is a well with raised top edge and overhung rim. Compass pocket (38) is a well with an overhung rim.

Figure 4:
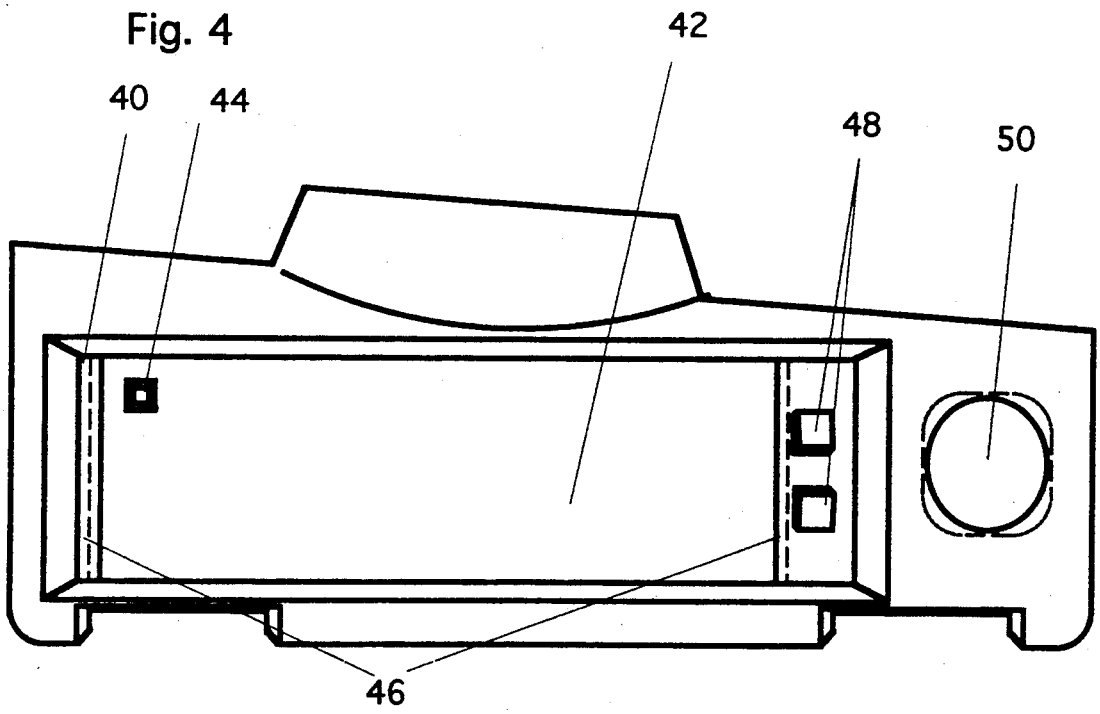
FIG. 4 is a right side view of device constructed in accordance with my invention showing slate plane, slate holder, pencil holder, thermometer holder, secondary pencil mount provision, and mounting pockets.

FIG. 4 is a right side view of device showing slate plane (40), slate holder (42) (FIGS. 4,7), slate depression (44), slate overhangs (46), pencil keepers (48) (FIGS. 3,4,7), and thermometer holder (50) (FIGS. 3,4,7). Slate holder (42) has two slate overhangs (46) at opposite ends and a slate depression (44). Pencil keepers (48) are spaced 0.27+−0.005 inches apart. Thermometer holder (50) is a shallow pocket with overhung rim and groove on bottom.

Figure 5:
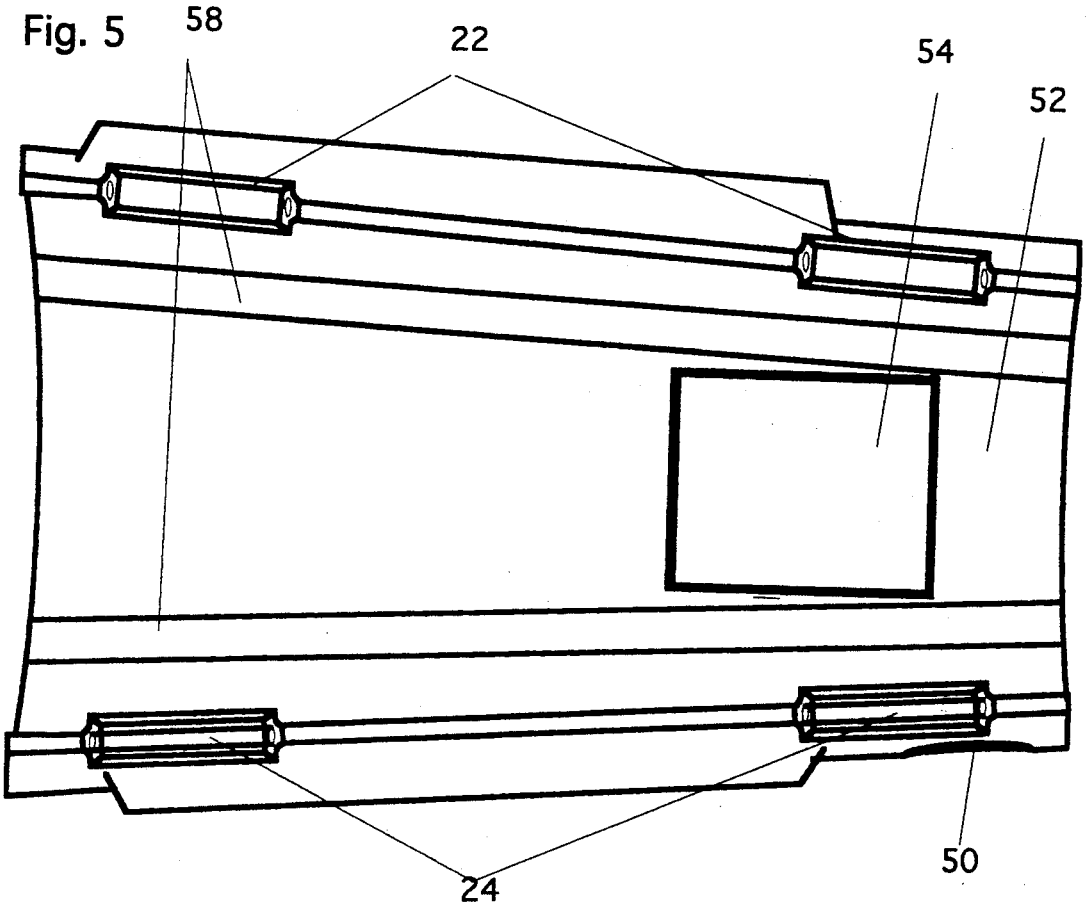
FIG. 5 is a bottom view of device constructed in accordance with my invention showing mounting pockets, rigid rod, anti-roll/slip relief, contored interior cavity, and thermometer holder.

FIG. 5 is a bottom view of device showing mounting pockets (22) (FIGS. 2,5,6,10), contored interior cavity (52), and anti-roll/slip relief (54). Contored interior cavity (52) is a ½ non-linear cone shaped surface with radial dimensions that are proportionate to typical radial dimensions of a human arm. Relief for anti-roll/slip protection (54) is a 0.05 deep depression which follows the same contour of contored interior cavity (52). Into anti-roll/slip relief (54) is fastened the hook component of a hook and loop fastener which mates with a loop component of a hook and loop fastener that can be fastened to a divers suit (not shown).

Figure 6:
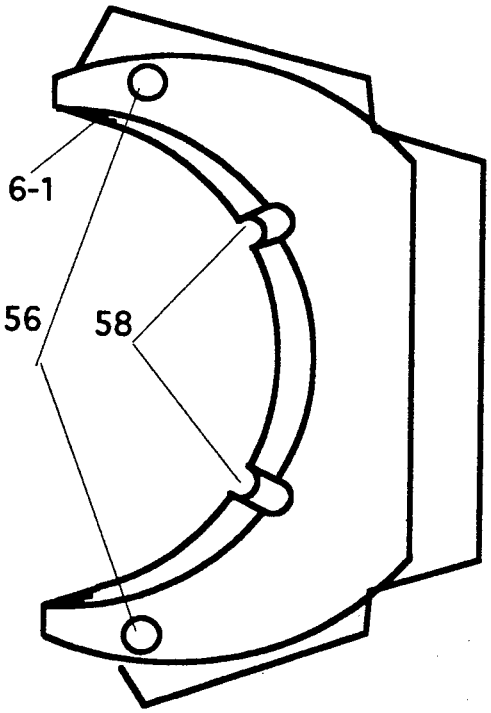
FIG. 6 is a back view of device constructed in accordance with my invention showing rod bores, air channels, and location of detail 6-1 shown in FIG. 10.

FIG. 6 Shows bores (56) (FIGS. 6,10) into which a semi-rigid rod (24) (FIGS. 5,11) is inserted. Diameter of bores (56) at back end is smaller that diameter of main length of bores. Air channels (58) (FIGS. 5,6,7) are also shown.

FIG. 7 shows air channels (58) (FIGS. 5,6,7), which, are hemispherical rabbetts, or grooves, running from front to back of contored interior cavity (52).

Figure 8:
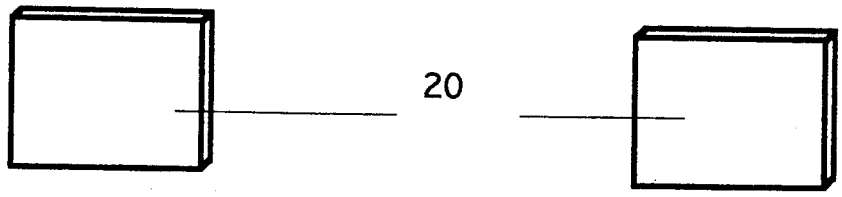
FIG. 8 shows plastic tabs used in a device constructed in accordance with my invention.

FIG. 8 shows plastic tabs (70). Plastic tabs are cut from sheet form PVC, ABS., or similar material. The width of plastic tabs (70) varies depending on the width of a knife sheath (not shown) through which tabs are inserted.

Figure 9:
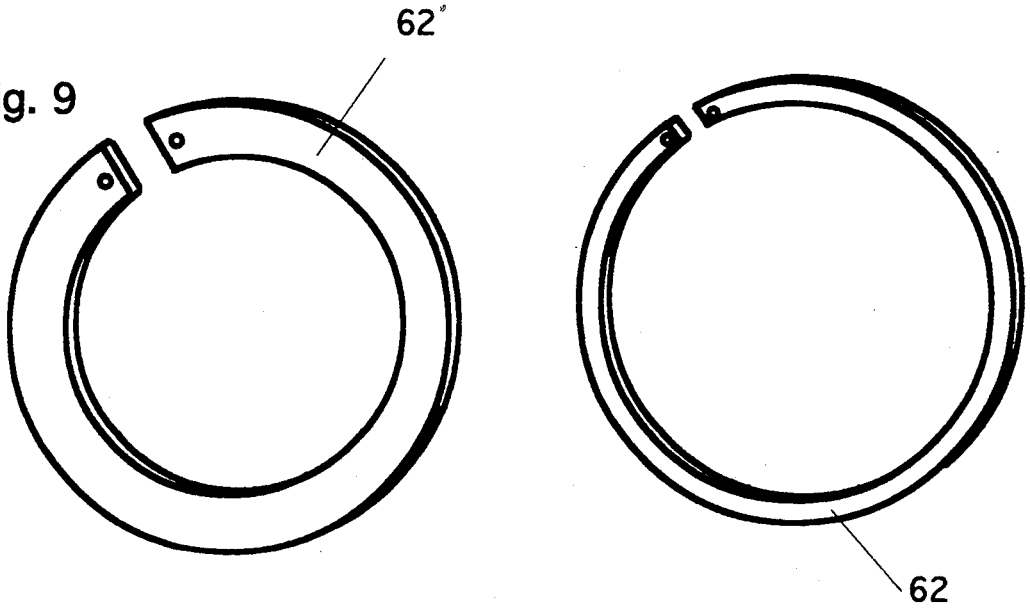
FIG. 9 shows keepers used in a device constructed in accordance with my invention.

FIG. 9 shows keepers (62). Keepers are die-cut from sheets or rod stock of plastic, treated wood, composite, metal or similar material with a durometer greater than shore A 75. Keepers (62) are concentric with an outside diameter equal to outside diameter of compass pocket (38) or depth gauge pocket (36). Inside diameter of keepers (62) is dependent upon outside diameter of gauge, bottom timer, compass, or suitable gauge or device.

Figure 10:
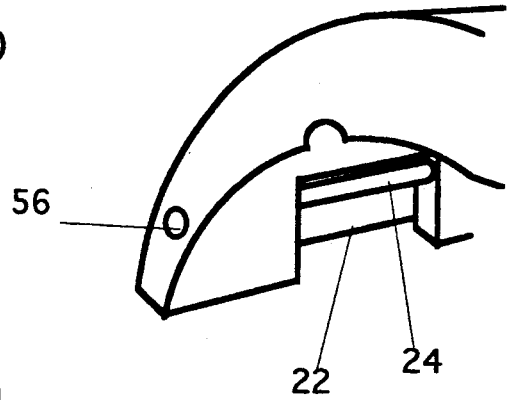
FIG. 10 shows detail 6-1 of mounting pocket, rigid rod, and bore of device constructed in accordance with my invention.
Figure 11:
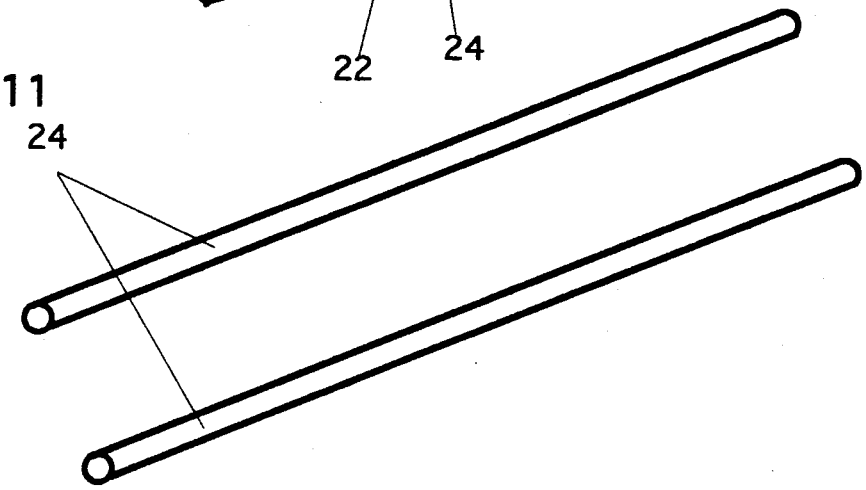
FIG. 11 shows rigid rods used in a device constructed in accordance with my invention.

FIG. 10 shows detail 6-1 of mounting pocket (22) (FIGS. 2,5,6,10), rigid rod (24) (FIGS. 5,10,11), and bore (56) (FIGS. 6,10). Bore (56) is exposed at mounting pocket (22). Straps (20) are looped around rigid rod (24). FIG. 11 shows rigid rods (24) (FIGS. 5,10,11). Rigid rods (24) are stock or milled plastic, wood, or any material with a shore A greater than 75.

OPERATION OF THE INVENTION

Device (FIGS. 1-11) is fastened to a divers forearm with straps (20) that are looped around semi-rigid rods (24) inside of mounting pockets (22). When secured, the front-end has a smaller interior circumference than the divers wrist and thus prevents the device from slipping off the arm. A contored interior cavity (52) ensures that the interior cavity of the device is in contact with the divers forearm throughout the length of the device. Air channels (58) on the interior of contored cavity (52) serve two functions: they provide a break in the constriction of the straps and they enable the flexible material of the device to form a flat plane on the top of the wrist. Air channels (58) allow for circulation beneath the substance of the device and prevents the device from rolling on the arm in the same manner that a watch and watchband do not roll around a wrist once the watchband is securely fastened. A 1.5×2" hook component of a hook and loop fastener is secured in anti-roll/-slip relief (54) to provide additional slip and roll protection when the device is worn over a thick material. A knife sheath can be inserted into knife holder (28) and held securely to the device by means of plastic tabs (70) which are inserted into the knife sheath so that they project from existing strap mounts on the sheath. Plastic tabs (70) interface with overhangs (32) within the knife holder (28).

A watch may be inserted or removed from the device by bending the device along horizontal and vertical sections whose axis converge upon the watch pocket (34). The device may not be bent enough to remove a watch while being worn.

A common divers depth gauge or bottom timer may be inserted into depth gauge pocket (36) and held in place by means of a keeper (62). Keeper (62) has an inside diameter measuring smaller than the greater diameter of the gauge. Keeper (62) interfaces with overhangs within the depth gauge pocket (36).

A common divers compass may be placed into compass pocket (38) and held in position by means of a Keeper (62).

A plastic slate or writting tablet may be inserted into slate holder (42) and held in place by slate overhangs (46) at two opposite ends of slate holder (42). A depression (44) in slate holder (42) may accommodate secondary pencil mounts. A pencil, when placed between the pencil keepers (48) is held in place by friction and compression.

A common divers thermometer may be inserted into thermometer dog by bending the flexible material comprising the main body of device along two dimensions whose axis converge of the thermometer holder (50). Substantial overhangs comprising the thermometer holder (50) secure the thermometer in position in such a manner that the thermometer cannot easily be removed while the device is being worn.

In another embodiment, a gauge plane (64), is formed from a separate section of material from main body of device. Shape of gauge plane is formed to interface with a variety of devices whose interface dimensions conform to those of the gauge plane (64). The separate section comprising the gauge plane is then secured to the device with glue, ultrasound, heat bonding, or process achieving similar result.

In another embodiment, an insert on the mold cavity forming knife holder (28) may be changed to produce another shape in the knife plane (26) so long as the shape conforms to the dimensions of knife plane (26).

In another embodiment, an insert within the mold cavity forming slate plane (40) may be changed to produce another shape in the slate plane (40) so long as the shape conforms to dimensions of slate plane (40).

CONCLUSION, RAMIFICATIONS, AND SCOPE OF INVENTION

Thus the reader can see that the gauge mounting device is a safe, efficeint means for securing equipment essential to safe diving practice. The device makes it possible to effectively utilize the prefered gauges and devices. The device is useful for training, professional, and sport diving because it enables a diver to use gauges and devices with and without an air tank, because it locates gauges where they will be highly visible to a diver, and because it does not constrain movement to the degree other devices of similar function do.

While my above description contains many specificites, these should not be construed as limitations on the scope of my invention, but rather as an exemplification of one preferred embodiment thereof. Many other variations are possible. For example, a dive table or other information may be imprinted upon the slate, the sequence of pockets and dogs may be reversed or altered so that, for instance, the slate will always appear on the side of the arm closest to the body or on the forearm opposite the writing hand. Another variation could be the substitution of a variety of fasteners instead of the plastic retaining rings, or keepers.

Nor should the scope of the device be limited only to the field of diving. As the mounting device is to some extent able to hold devices of different dimensions, other instruments which are more relevant to another field may be utilized. For instance, an atmospheric pressure sensitive altimeter may be substituted for a depth gauge and hence the device may be useful to those in the field of mountaineering or aviation.

I claim:

1.A device for mounting gauges or instruments to a human forearm comprising: a mounting structure of a flexible material having an outer surface, an inner surface, and opposite ends and being sized to extend over a substantial length of a forearm and adapted to conform to a human forearm when placed longitudinally thereon and including longitudinal grooves defining air channels on said inner surface extending the entire length thereof and through said opposite ends; the device further including semi-rigid rods for removable insertion within the mounting structure adjacent and parallel to said grooves for providing rigidity to said mounting structure; said outer surface including at least one receptacle for removably retaining at least one gauge or instrument; and means for securing said device to said forearm.

2. The device of claim 1 further including means for preventing slipping and rolling of the device on the forearm, said preventing means including an interior recess on said inner surface adapted to receive a first hook and loop type fastener component which is cooperable with a second hook and loop type fastener component on the user; said securing means including straps connected to said structure and cooperable with each other to secure said device around a forearm.

3. The device of claim 1 wherein said at least one receptacle for retaining a gauge includes means for quickly removing or inserting said at least one gauge, said removing or inserting means includes a retaining ring which surrounds the at least one gauge in a frictional fit and which cooperates with the at least one receptacle for removably retaining the at least one gauge in the at least one receptacle; and wherein said at least one receptacle for retaining an instrument includes means for quickly removing or inserting said at least one instrument includes overhangs on the at least one receptacle which are cooperable with plastic tabs for removably retaining the at least one instrument in the at least one receptacle.

4. The device of claim 1 wherein the at least one gauge is a compass.

5. The device of claim 1 wherein the at least one gauge is a watch.

6. The device of claim 1 wherein the at least one instrument is a knife.

7. The device of claim 1 wherein the at least one instrument is a slate.

* * * * *